United States Patent [19]

Brown, Jr. et al.

[11] Patent Number: 4,593,417

[45] Date of Patent: Jun. 10, 1986

[54] CONVERTIBLE SURVIVAL CAP

[76] Inventors: William C. Brown, Jr.; Margie E. Brown, both of Rte. 1, Box 110B, Jonesville, La. 71343

[21] Appl. No.: 649,685

[22] Filed: Sep. 12, 1984

[51] Int. Cl.[4] ..... A42B 1/06

[52] U.S. Cl. ..... 2/209.1; 2/205; 2/206

[58] Field of Search ..... 2/209.1, 209.2, 202, 2/206, 204, 196, 205, 209.3

[56] References Cited

U.S. PATENT DOCUMENTS

| | | | |
|---|---|---|---|
| 1,056,391 | 3/1913 | Baldwin | 2/204 |
| 1,512,128 | 10/1924 | O'Brien | 2/196 |
| 2,686,317 | 8/1954 | Michaelis | 2/205 |
| 2,839,757 | 6/1958 | Gianola | 2/205 |
| 3,275,106 | 9/1966 | Rush | 2/209.1 |

FOREIGN PATENT DOCUMENTS

| | | | |
|---|---|---|---|
| 651501 | 2/1929 | France | 2/205 |

OTHER PUBLICATIONS

Gershmou "Journal of A.M.A"vol. 168 No. 7 p. 980 10-1958 *Self Adhering Nylon Tapes.*

*Primary Examiner*—Werner H. Schroeder
*Assistant Examiner*—Mary A. Ellis
*Attorney, Agent, or Firm*—Pravel, Gambrell, Hewitt & Kimball

[57] ABSTRACT

The present invention relates to headwear and more particularly relates to a convertible survival hat which selectively covers multiple areas of the wearer's head, face and neck.

4 Claims, 6 Drawing Figures

CONVERTIBLE SURVIVAL CAP

GENERAL BACKGROUND

Various outdoor activities including outdoor sports, winter sports, hunting, and fishing often subject a participant to bitterly cold weather. Such activities as, for example, duck hunting, goose hunting, ice fishing, snow mobiling, skiing and the like subject the participant to extremely cold temperatures which are sometimes accompanied by high winds and chill factor.

Many times persons working in areas which are not protected from wind such as sailors, or offshore oil rig workers are subjected to high winds and cold temperatures which can cause a great deal of discomfort to the head and facial areas.

It is well-known that the head and neck areas of a human are significant areas of heat loss during cold weather. The use of full coverage hats for the purpose of keeping an individual warm during cold weather has been a common practice.

A significant problem which accompanies full coverage hats is that they become quite uncomfortable during a rapid temperature rise. For example, it is common for a duck hunter, deer hunter, or goose hunter to be subjected to chilling temperatures of below zero in the early morning hours and yet be warmed significantly as the day progresses and the sun begins to shine. It is not unusual for pre-dawn temperatures to be at or below 0° F. and noon day temperatures to rise to 40° F.–70° F. if the sun is bright. Various types of caps and hats are convertible having flaps which can cover the ears of the individual and yet fold upwardly onto the crown of the hat in order to expose the ears as temperatures warm. These hats however do not protect the facial areas of the wearer. One such convertible type cap can be seen in the Rosenberg patent, U.S. Pat. No. 1,639,468 issued Aug. 16, 1927 and entitled "Cap." In that patent, FIGS. 1 and 3 show a cap with the ear flaps in a downward position and in an upward position respectively.

Some hats or hoods provide a downwardly depending skirt which extends from the crown to the upper shoulder area of the individual thus covering the neck area of the wearer. For example, the Gianola patent entitled "Head Covering Garmet" (U.S. Pat. No. 2,839,757) shows a garmet comprised of fabric tailored to provide area which respectively cover the top, back and sides of the wearer and the tailored fabric extends downwardly from the back and side areas to constitute respective areas that cover the back and sides of the neck of the wearer. A pair of baffles are retracted into the walls of the skirt so that they can be stored when not in use. A fabric web of flexible material is secured inside a pocket on each side of the skirt. When a particular baffle is inserted into its pocket, the web of material folds upon itself and when the baffle is withdrawn from the pocket for use, the web locates the rearward edge of the baffle at the front edge of the hood and slightly inside the pocket. The baffles are also removable when weather conditions render them useless.

U.S. Pat. No. 1,316,778 entitled "Combined Cap Scarf" issued to L. H. Ensten in 1919 relates to a combined cap and scarf, which provides a cap with angular flaps at each side, together with a broad band stitched to the angularly-related edges of the flaps at the back of the cap, and with separate long pendent ends at the front of the cap.

U.S. Pat. No. 1,437,244 entitled "Headwear" issued to M. E. Heinrich in 1922 relates to improvements in head wear and particularly to an article which may be worn as a helmet cap, with strap portions extending downwardly and fastened beneath the chin of the wearer so as to confine the hair: these strap portions also being adapted to be turned up against the sides of the crown portion of the article, the construction being such as to give the appearance of an attractive hat.

U.S. Pat. No. 2,686,317 entitled "Head Wearing Apparel" issued in 1954 to H. O. Michaelis. An object of this apparatus is the provision of a cap or hood for receiving the entire head and face of the wearer and wherein certain portions of the face covering sections of said cap or hood may be swung laterally away from the face and held in positions to provide an opening through which the eyes, nose, mouth, and chin of the wearer may be exposed, provision also being made at the same time to securely fasten the hood or cap around the wearer's neck with a more or less snug fit.

U.S. Pat. No. 2,743,454 entitled "Insulated Sound Transmitting Ear Cells for a Cap" issued in 1956, discloses a winter cap for use by members of the armed services, and the like, having means adjacent to the ears of the wearer for protecting the ears from cold and wind, but readily admitting sound.

U.S. Pat. No. 3,205,508 entitled "Safety Helmet Liner and Assembly" issued in 1965 to W. W. Cox. This patent shows a winter liner which is adapted for assembly within any safety helmet for providing means, without buckles or straps, for anchoring the ear flaps against the neck during use and alternately for holding the flap ends up against the safety helmet itself when desired; and further provides increased sound transmission through the flaps while yet retaining a certain degree of protection from the elements.

A French Pat. No. 420,634 shows a hood-like hat that connects under the chin.

A U.S. Pat. No. Des. 189,233 entitled "Hood" issued in 1960 shows an ornamental design for a hood having a skirt which could cover the wearer's neck.

The above devices suffer in that they are either too complicated and/or do not provide a fully covering hat which protects all areas of the face, yet convertibility into multiple positions depending upon weather conditions.

GENERAL DESCRIPTION OF THE PRESENT INVENTION

The present invention solves these prior art problems and shortcomings in a simple and straightforward manner. The present invention thus provides a convertible headwear for fowl weather conditions which can be converted into multiple positions as weather conditions deteriorate and/or improve. The headwear of the present invention can initially provide full coverage, for example, in the early morning hours of a duck hunt when temperatures might be at or below 0° Farenheit. As the day progresses and weather conditions improve, the device can be converted into multiple positions which selectively cover either: (1) the neck area while exposing the eyes, nose and mouth, (2) the side and rear neck area while exposing the eyes, nose, mouth and forward neck area, (3) the crown portion of the head of the wearer while exposing the neck and face areas, and (4) full coverage of all areas of the head and neck with the exception of the eyes, needed for viewing.

The present invention thus provides a full coverage yet convertible fowl weather head wear having a crown portion which covers the head of the wearer generally above the wearer's ears and eyes. A skirt assembly extends down from the crown portion to a position below the wearer's neck and circumferentially around the wearer's neck so that it covers the side and rear neck, terminating generally at the wearer's face. A first pair of independently closable flap covers cooperate to cover the wearer's nose and mouth areas, but can be folded rearwardly to a position which abuts the skirt assembly so that the flaps are removed from obstructing the face of the wearer yet are neatly carried by the skirt. A second pair of independently closable flap covers cooperate to cover the wearer's forward neck area, yet also can be folded rearwardly upon the skirt if desired. Since each of the independently movable pairs of flaps can be removed from their forward position covering a portion of the face, they can be folded and carried with the skirt to an upper position upon the crown so that the entire assembly of the first and second pairs of flaps and the skirt can be removed from the neck and face areas entirely and carried upon the crown as weather conditions improve and as temperature rises. Thus, the present invention provides a very versatile headwear which is easy to use, simple to construct and highly efficient in protecting the wearer during all types of weather conditions.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PRESENT INVENTION

Figure 1:
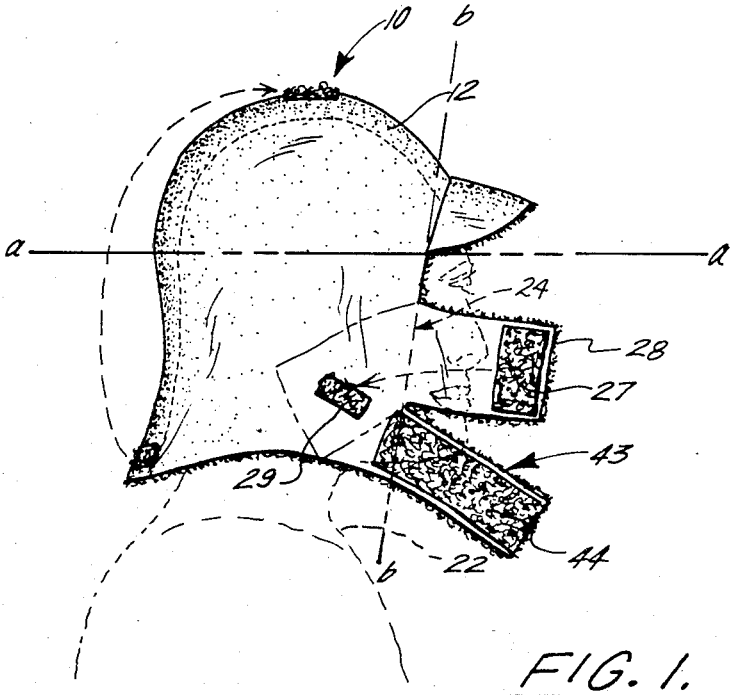
FIG. 1 is a side view of the preferred embodiment of the apparatus of the present invention showing the skirt unfolded and the flaps disconnected.
Figure 2:
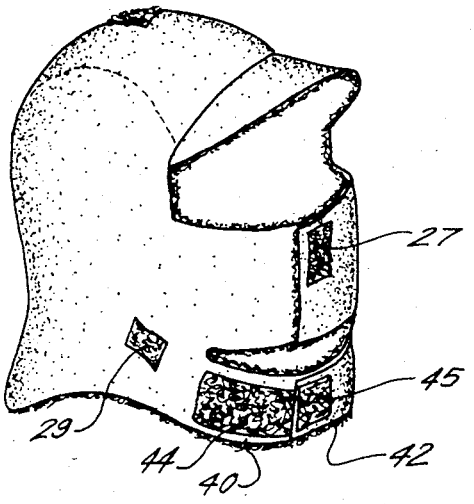
FIG. 2 is a perspective view of the preferred embodiment of the apparatus of the present invention showing the skirt unfolded and the upper and lower flaps connected to cover the wearer's face.
Figure 3:
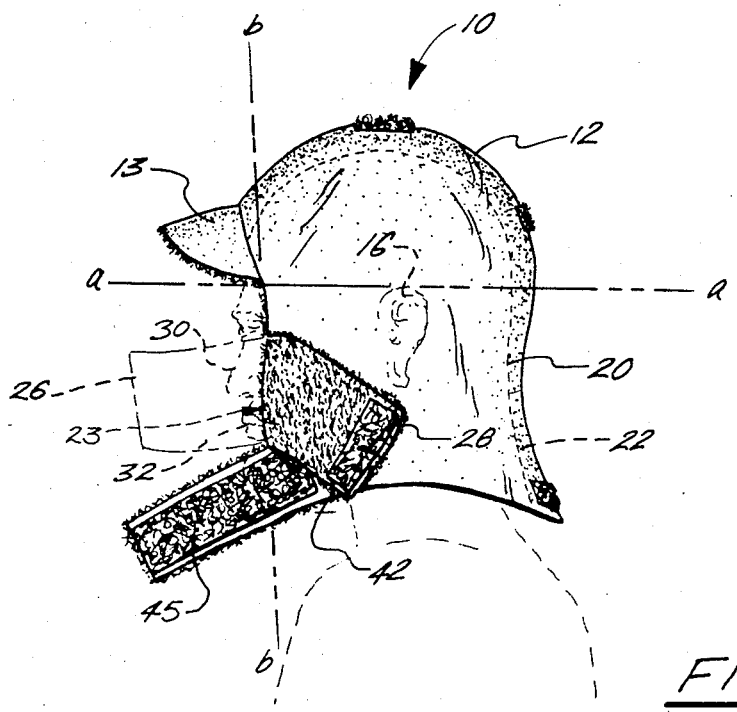
FIG. 3 is a side view of the preferred embodiment of the apparatus of the present invention showing one of the flaps in a retracted position and folded upon the skirt.
Figure 4:
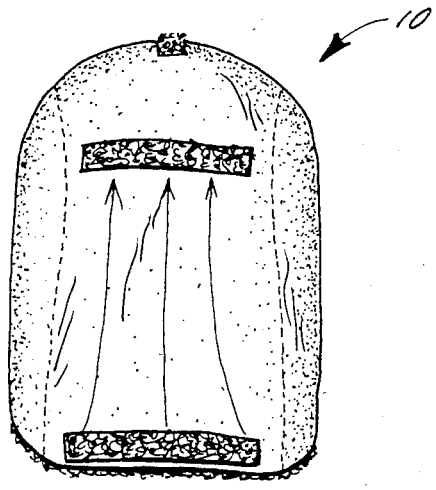
FIG. 4 is a rear view of the preferred embodiment of the apparatus of the present invention showing the skirt unfolded.
Figure 5:
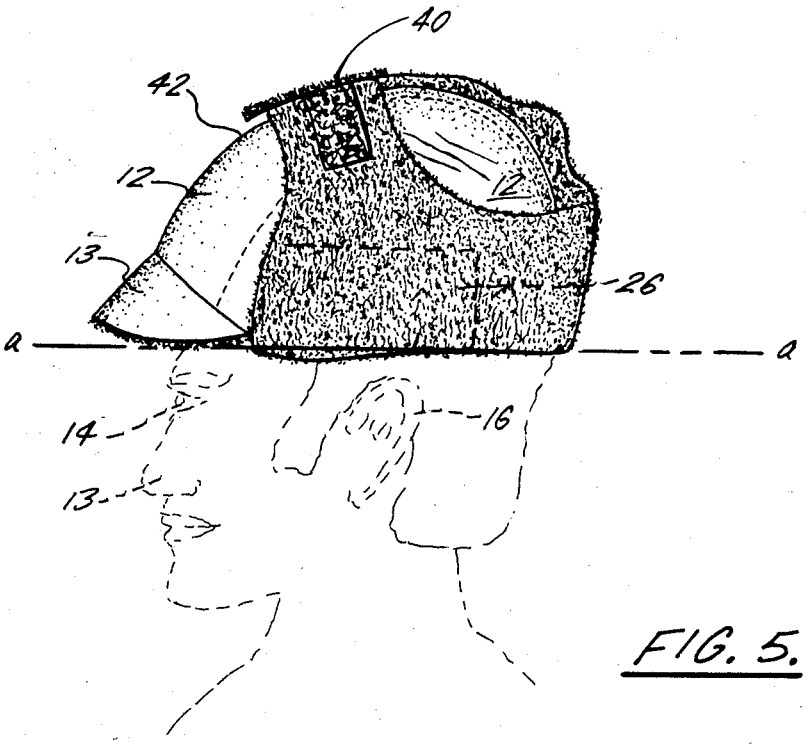
FIG. 5 is a side view of the preferred embodiment of the apparatus of the present invention showing the flaps and skirt in a folded position upon the crown.
Figure 6:
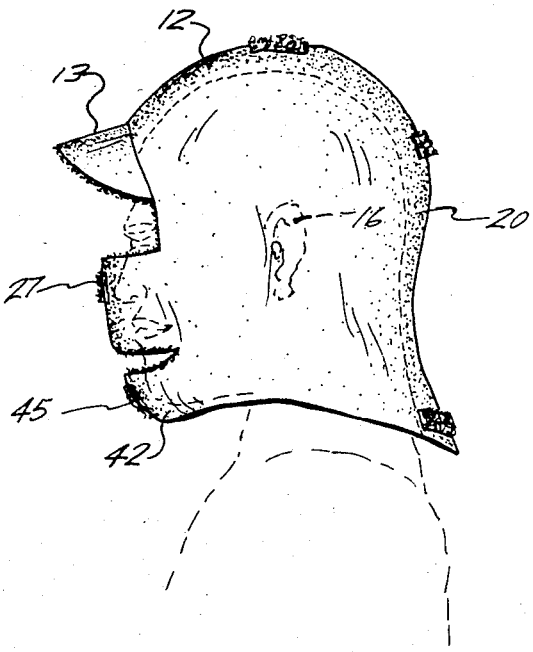
FIG. 6 is a side view of the preferred embodiment of the apparatus of the present invention showing the flaps secured about the wearer's face and the skirt unfolded.

FIGS. 1-5 show the preferred embodiment of the apparatus of the present invention designated generally by the numeral 10. Convertible survival cap 10 as more fully described hereinafter provides selective full or partial coverage of the wearer's head, neck and face areas. A crown 12 portion covers the head of the wearer generally above the wearer's eyes 14 and ears 16. The crown 12 has a forwardly extending brim 13. In FIGS. 1, 3 and 5, the crown 12 is that portion generally above the dotted line a—a. A foldable skirt 20 extends downwardly from the crown 12 portion to a position below the wearer's neck 22 and circumferentially around the wearer's neck 22. The skirt 20 terminates at left 23 and right 24 skirt edges which generally coincide with the peripheral sides of the wearer's face when the skirt 20 is unfolded. In FIGS. 1 and 3, the dotted line b—b generally indicates the peripheral sides of the wearer's face and the left 23 and right 24 skirt edges.

A first upper pair of independently closable left and right flap covers 26, 28 are attached to an extend respectively from the left 23 and right 24 skirt edges. The upper pair of flap covers 26, 28 are connectable in a forward position with respect to the wearer's head (see FIG. 2) that covers the wearer's nose 30 and mouth 32 areas. The upper pair of flap covers 26, 28 can be folded at the skirt edges 23, 24 to a rearwardly removed position which abuts the skirt 20 (see FIGS. 1, 3) to expose the wearer's nose 30 and mouth 32. Each upper flap cover 26, 28 includes an inner Velcro fastener 27, one of the flap covers 26, 28 includes an outer Velcro fastener 27. Cooperating Velcro fasteners 29 are positioned upon the skirt 20 so that each upper flap cover can be folded at the skirt edges 23, 24 to a rearwardly removed position.

A second pair 40, 42 of independently closable flap covers are placed generally below the first pair of flap covers 26, 28 but are independently movable with respect to the first pair 26, 28 of flap covers. The second lower pair 40, 42 of independently closable flap covers are however likewise attached to and extend respectively from the left and right skirt edges 23, 24. Each pair 40, 42 of the closable flap covers connects with the other in a forward position which covers the wearer's forward neck area 43.

Lower flaps 40, 42 each carry external Velcro fasteners 44, 45. Left lower flap 40 provides both exterior and interior surface Velco fasteners 27. The crown 12 carries Velcro fastener 50 at its apex 52 and an additional Velco fastener 55 at the rear area of the crown 12. The skirt 20 carries a Velcro fastener 57 at its rear lower edge which cooperates with the fastener 55 upon the crown 20.

Convertible survival cap 10 as aforedescribed can be worn in three different positions. The first position (FIG. 2) provides full coverage of the head, neck, and facial areas of the wearer except the eyes 14. The second position (FIG. 3) covers all of the aforedescribed positions of the wearer's head but exposes the nose and mouth. The third position (FIG. 5) only covers the crown of the wearer's head above the ears and eyes of the wearer. Thus, the first position would be used in bitter cold or freezing temperatures. The second position is a transitional position which could be used as temperatures rise or fall as the case may be or when temperatures are moderate such as in the 35° F.-50° F. range. The third position is used as temperatures become warmer such as, for example, 50° F.-70° F. The above temperature ranges are merely illustrative, of course, as the individual wearer is afforded a tremendous comfort range which can be adjusted to the individual's desires.

Convertible survival cap 10 could be manufactured of any suitable warm material such as, for example, a laminated fabric of fur or lamb's wool as an inner layer, with an outer layer of nylon, leather, fabric or the like.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. A convertible survival cap providing selective full or partial coverage of the wearer's head, neck and face areas, comprising:

a. a crown portion which covers the head of the wearer generally above the wearer's ears and eyes;

b. a foldable skirt which extends downwardly from the crown portion to a position below the wearer's neck and circumferentially around the wearer's neck, terminating at left and right skirt edges which generally coincide with the peripheral sides of the wearer's face when the skirt is unfolded;

c. a first upper pair of independently closable flap covers attached to an extending respectively from the left and right edges of the skirt, the upper flap covers being connectable together in a first "forward" position for that covering the wearer's nose and mouth area, and the upper flap covers can be folded at the skirt edges to a second "rearward" position in which the upper flap covers abut and connect to the skirt to expose the wearer's nose and mouth;

d. a second lower pair of independently closable flap covers positioned below the upper flap covers, each lower flap cover being independently movable with respect to the first pair of upper flap covers but which are likewise attached to and extending respectively from the left and right skirt edges, the lower flap covers being connectable together in a forward position for covering the wearer's forward neck area;

e. upper flap connector means carried by the upper pair of flap covers for selectively affixing the upper pair of flap covers in a preselected forward and in a rearward position; and f. the skirt being foldable generally along a line where the skirt connects to the crown so that when the upper flaps are in the rearward position and the lower flaps are disconnected, the skirt, the rearwardly positioned upper flap covers, and the lower flap covers can be folded upon the crown to expose the wearer's neck, face and ears.

2. The convertible survival cap of claim 1 further comprising lower flap connector means carried by the lower flaps for connecting them together on the top of the crown when the skirt is folded upon the crown.

3. The convertible survival cap of claim 2, wherein the means includes multiple connectors placed respectively on the inner and outer surfaces of the lower flaps.

4. The convertible survival cap of claim 1, wherein the means includes multiple connectors placed respectively on the inner and outer surfaces of the upper flaps.

* * * * *